United States Patent [19]

Stamm

[11] Patent Number: 4,824,127

[45] Date of Patent: Apr. 25, 1989

[54] CANOE CARRIER

[76] Inventor: Lawrence G. Stamm, 1498 Brookside Dr., San Leandro, Calif. 94577

[21] Appl. No.: 104,934

[22] Filed: Oct. 6, 1987

[51] Int. Cl.[4] ..... B62B 1/04

[52] U.S. Cl. ..... 280/47.331; 114/344; 114/347; 224/273; 280/47.3; 280/47.32

[58] Field of Search ..... 280/47.13 B, 47.14, 280/47.32, 414.1, 414.2, 414.3, 47.3, 47.37 R, 201; 114/344, 347, 364, 343; 224/42.45 R, 273, 915

[56] References Cited

U.S. PATENT DOCUMENTS

| | | | |
|---|---|---|---|
| 530,437 | 12/1894 | Mason | 280/47.3 |
| 1,109,520 | 9/1914 | Flower | 280/47.32 |
| 1,376,496 | 5/1921 | Woodruff | 280/47.13 B |
| 2,551,040 | 5/1951 | Newell | 280/47.13 B |
| 2,622,893 | 12/1952 | Wasserlein | 280/47.13 B |
| 3,130,842 | 4/1964 | Melloni | 280/414.1 |
| 3,271,798 | 9/1966 | Zoretic | 280/47.32 |
| 3,284,821 | 11/1966 | Zoretic | 280/47.32 |
| 4,538,829 | 9/1985 | Horowitz | 280/47.13 B |
| 4,602,802 | 7/1986 | Morgan | 280/47.13 B |
| 4,603,872 | 8/1986 | White | 280/47.13 B |
| 4,641,874 | 2/1987 | Grenzer | 114/347 |

FOREIGN PATENT DOCUMENTS

| | | | |
|---|---|---|---|
| 492927 | 5/1953 | Canada | 280/47.32 |
| 9268 | 5/1897 | United Kingdom | 280/201 |

*Primary Examiner*—Charles A. Marmor
*Assistant Examiner*—Eric Culbreth
*Attorney, Agent, or Firm*—Leon Gilden

[57] ABSTRACT

A portable canoe carrier apparatus is set forth wherein a central carrier portion supports a medial portion of a canoe in a mobile fashion by means of associated wheels. The central portion has formed along an inner surface, a plurality of inflatable air cushion devices to accommodate variations in hull size of an associated canoe. First and second terminal support portions have integrally formed handles thereto for manual transport and guidance of said canoe body.

1 Claim, 1 Drawing Sheet

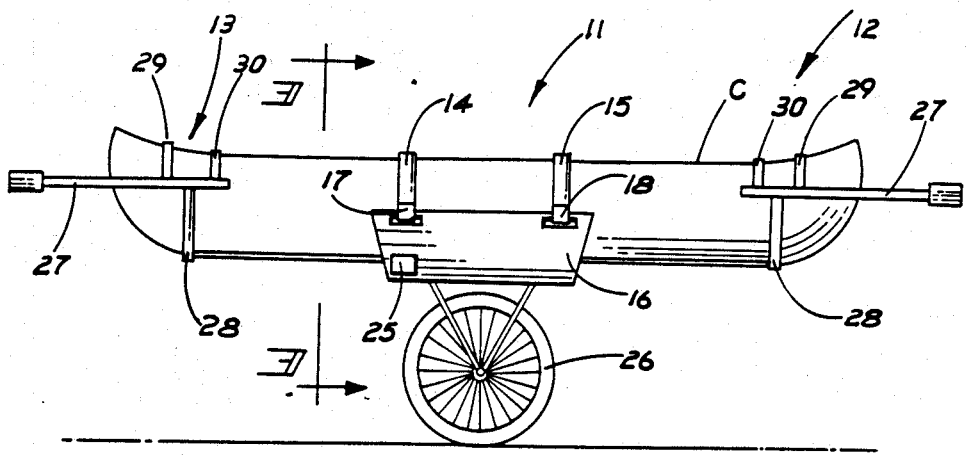
FIG 1
FIG 2
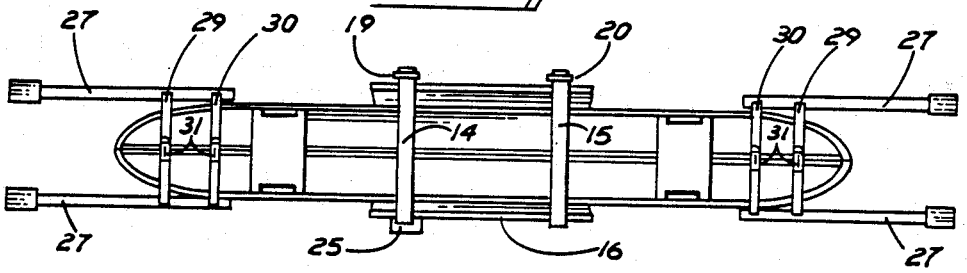
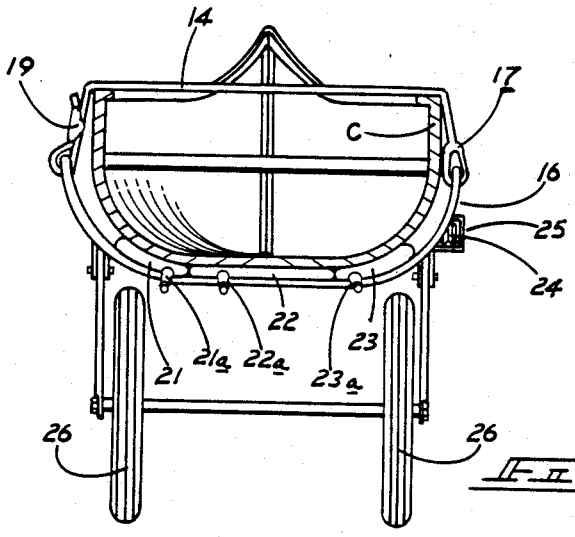
FIG 3

CANOE CARRIER

BACKGROUND OF THE INVENTION

1. Field of the Invention

The present invention relates to support devices, and more particularly pertains to a new and improved canoe carrying support device which when attached to an associated canoe enables same to be readily transported over a land surface and furthermore accommodate variation in a canoe's external configuration.

2. Description of the Prior Art

The use of support devices for canoes and similar water craft is well known in the prior art. As may be appreciated, these devices have normally required a water craft of particular configuration or were of bulky and awkward structure to resist their transport through land transport conditions, as is oft times the case in the transport of modern, light-weight canoe structures over various land formations to gain access to and from a particular body of water. In this connection there have been several attempts to develop canoe-like support devices which may be easily and efficiently adapted to and utilized in association with a canoe-like device. For example, U.S. Pat. No. 1,109,520 to Flower illustrates the use of a canoe carrier which secures a forward wheel to a forward portion of a canoe creating a wheelbarrow effect enabling transport of said canoe. The device is of a rather awkward configuration for transport and storage of a canoe and resists accommodation of canoes of various external configurations.

U.S. Pat. No. 1,376,496 to Woodruff sets forth a spring loaded axle support apparatus for support of a canoe that may be secured in a trailer-like fashion behind a motor vehicle for towing of said canoe. The apparatus is, as the previous patent, of bulky and rather substantial construction to resist application other than to a specific boat configuration as set forth by the patent.

U.S. Pat. No. 2,551,040 to Newell sets forth the use of a trailer-like apparatus attached to a rearward portion of a boat for transporting same. The device comprises a wheeled cart-like device which enables a user to grasp a forward portion of the associated boat for transport of same. The instant patent provides no further advantage in the transport of vehicles such as boats than the previously cited patents.

U.S. Pat. No. 2,622,893 to Wasserlein sets forth a further exiled trailer arrangement with associated wheels for support of a boat about a mid portion thereof for general attachment to a tow vehicle such as an automobile. The device is again of rather complicated and substantial structure and as other prior art devices, resists application to a wide variety of boat configurations as does the instant invention.

U.S. Pat. No. 3,271,798 to Sclerotic sets forth a two part support cradle for a canoe wherein a trailer-like apparatus supporting wheels is pivoted in sections about either side of a canoe to enable mobile transport thereof. This device fails to provide a useful improvement over other prior devices in the transport of canoe-like vehicles and similarly, U.S. Pat. No. 3,284,821 also to Sclerotic is merely a variation of the same idea but utilizing a modification of the pivoted supports of the wheels formed through securement within the internal cavity of the boat when not in use.

As such it may be appreciated that there is a continuing need for a new and improved canoe support apparatus which addresses both the problem of storage and portability and in this respect, the present invention substantially fulfills this need.

SUMMARY OF THE INVENTION

In view of the foregoing disadvantages inherent in the known types of canoe carriers now present in the prior art, the present invention provides a canoe carrier which includes a central support portion including accommodating means to support a variety of canoe configurations and associated terminal support portions for secure manual support and guidance of said canoe. As such, the general purpose of the present invention, which will be described subsequently in greater detail, is to provide a new and improved canoe carrier which has all the advantages of the prior art canoe carriers and none of the disadvantages.

To attain this, the present invention comprises a central canoe carrier support portion wherein a carriage-like apparatus includes a plurality of inflatable chambers for accommodating a variety of canoe configurations and for minimizing damage to a supported canoe's surface. Additionally, manual support portions are securable to each end of said canoe for positive manual grasping and guidance of said canoe for portage thereof.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved canoe carrier which has all the advantages of the prior art canoe carriers and none of the disadvantages.

It is another object of the present invention to provide a new and improved canoe carrier which may be easily and efficiently manufactured and marketed.

It is a further object of the present invention to provide a new and improved canoe carrier which is of a durable and reliable construction.

An even further object of the present invention is to provide a new and improved canoe carrier which is susceptible of a low cost of manufacture with regard to both materials and labor, and which accordingly is then susceptible of low prices of sale to the consuming public, thereby making such canoe carriers economically available to the buying public.

Still yet another object of the present invention is to provide a new and improved canoe carrier which provides in the apparatuses and methods of the prior art some of the advantages thereof, while simultaneously overcoming some of the disadvantages normally associated therewith.

Still another object of the present invention is to provide a new and improved canoe carrier wherein a central support carriage accommodates a variety of canoe configurations by inflatable means to firstly accommodate the canoe configurations and secondly, minimize damage to said canoe surface.

Yet another object of the present invention is to provide a new and improved canoe carrier wherein a plurality of terminal support portions are securable to either end of said canoe for manual grasping and guidance of said canoe thereby.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view of the instant invention taken in elevation illustrating a central portion and first and second terminal support portions secured to an associated canoe.

FIG. 2 is an orthographic top view of the instant invention of FIG. 1.

FIG. 3 is an orthographic side view taken along the lines 3—3 of FIG. 1 in the direction indicated by the arrows.

DESCRIPTION OF THE PREFERRED EMBODIMENT

With reference now to the drawings, and in particular to FIG. 1 thereof, a new and improved canoe carrier embodying the principles and concepts of the present invention and generally designated by the reference numerals 11, 12 and 13 will be described.

More specifically it will be noted that the canoe carrier apparatus essentially comprises a central portion 11 formed to cooperate with a first terminal support portion 12 and a second terminal support portion 13. Said central portion 11 includes a pair of strap elements including a first strap element 14 and a second strap element 15 to extend around an associated canoe "C" about a medial portion thereof. Said first and second strap elements are adjustably associated with a support carriage 16 where they are secured at one of their ends in a fixed manner by means of rings 17 and 18 respectively. The first and second strap elements are thereafter adjustably secured to the other side of said carriage 16 by means of buckles 19 and 20 respectively.

Formed within the interior of support carriage 16 is a plurality of expandable chambers depicted as first expandable chamber 21, second expandable chamber 22, and third expandable chamber 23. Associated with each of said chambers are conventional low pressure first, second, and third valve element illustrated as 21*a*, 22*a*, and 23*a* respectively that may be either expanded by a user merely blowing into them as he would with conventional valves of this type as are commonly utilized with beach equipment or by use of an associated portable air pump 24 housed within an an integrally formed storage compartment 25. Finally, a pair of wheels 26 are supported by a conventional axle and support bracketry, as illustrated essentially in FIGS. 1 and 3 to said carriage 16. As illustrated in FIG. 1, forward and rear struts support said axles and accordingly said wheels 26 for a stable accommodation of a transported canoe.

First and second terminal support portions 12 and 13 are of similar construction and, as illustrated, an under body support strap 28 is configured to extend between spaced manual grasping handles 27 to support a canoe about its lower periphery. Spaced parallel straps 29 and 30 are adjustably securable by means of conventional buckles or other comparable adjustment means to adjustably and securely restrain the terminal ends of a canoe for transport essentially as illustrated.

As may be understood from the foregoing description and illustration, a canoe for portages positioned and forward and rear portions thereof have secured thereto first and second terminal support portions 12 and 13 by means of accommodating straps 29 and 30 and adjusted accordingly by means of the associated buckles. A canoe may then be positioned upon support carriage 16 whereupon the various expandable chambers 21, 22 and 23 are filled with support air, either by means of a standard portable air pump 24 positioned within compartment 25, or may be orally blown into by a user to expand the flexible expandable chambers. Relatively small pressures are required within chambers 21, 22, and 23 to provide for a firm but yielding supporting of an associated canoe whereafter first and second strap elements 14 and 15 are looped over the associated canoe and secured by means of the associated buckles 19.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A canoe carrier for portage of a canoe comprising, an arcuate carriage means for yieldingly supporting a canoe therein by means of cushioning means, respective first and second terminal support portion means about a canoe proximate its ends, each terminal support portion means including means for manual grasping and guidance of said canoe, wherein said means for manual grasping includes a pair of handles projecting away from said canoe for enabling manual grasping thereof, wherein each of said first and second terminal support portion means further includes an underlying body support strap positionable about an underside of said canoe connected to and extending between said handles, and a pair of adjustable support strap means extending between said handles for securement about an upper portion of said canoe for attachment of said first and second support portion means to respective ends of said canoe, wherein said carriage means includes a pair of first and second strap elements adjustably securable about the over periphery of said canoe, wherein said cushioning means on said carriage means includes a plurality of expandable chambers formed to an interior surface of said arcuate carriage means for yieldingly supporting said canoe, and wherein a portable air pump is secured within a storage compartment formed on an exterior surface of said carriage means.

* * * * *